US006318580B1

(12) United States Patent
Edy

(10) Patent No.: US 6,318,580 B1
(45) Date of Patent: Nov. 20, 2001

(54) WASTE CATCHMENT SYSTEM FOR ROLLERS

(75) Inventor: Clinton Wayne George Edy, Wolsingham (GB)

(73) Assignee: Gary Williamson, Tyne & Wear (GB)

( * ) Notice: Subject to any disclaimer, the term of this patent is extended or adjusted under 35 U.S.C. 154(b) by 0 days.

(21) Appl. No.: 09/763,591

(22) PCT Filed: Aug. 31, 1999

(86) PCT No.: PCT/GB99/02847

§ 371 Date: Feb. 26, 2001

§ 102(e) Date: Feb. 26, 2001

(87) PCT Pub. No.: WO00/13905

PCT Pub. Date: Mar. 16, 2000

(30) Foreign Application Priority Data

Sep. 2, 1998 (GB) ..... 9819010
Apr. 20, 1999 (GB) ..... 9908858

(51) Int. Cl.[7] ..... B41F 35/02; B65D 25/00

(52) U.S. Cl. ..... 220/495.02; 220/570; 220/495.01; 220/695; 101/425

(58) Field of Search ..... 101/424, 425; 220/495.02, 695, 495.01, 570

(56) References Cited

U.S. PATENT DOCUMENTS 4,165,965 * 8/1979 Bernardelli et al. ..... 101/425
4,928,843 * 5/1990 Gnderson ..... 220/695
5,259,313 * 11/1993 Gibson et al. ..... 101/425
5,271,326 * 12/1993 Ebina ..... 101/425
5,385,095 * 1/1995 Waizmann ..... 101/425
5,549,216 * 8/1996 Scholl ..... 220/695
5,746,346 * 5/1998 Crilly ..... 220/695

FOREIGN PATENT DOCUMENTS

8903674 U * 8/1989 (DE) .
0022459A * 8/1982 (EP) .
0414909A * 6/1991 (EP) .
0590833A * 4/1994 (EP) .

* cited by examiner

*Primary Examiner*—Joseph M. Moy
(74) *Attorney, Agent, or Firm*—Larson & Taylor PLC

(57) ABSTRACT

A waste catchment system for rollers (2), in particular printing press rollers, comprises an elongate tray (4), a blade assembly (6) attached to the tray (4) and including a blade (10) the free edge of which engages the roller (2) to remove waste material from the roller (2) and direct it towards the tray (4), and a liner (12) within the tray (4) to receive therein the waste material, the blade assembly (6) and one edge of the liner (12) being provided with co-operating male/female elements (20, 22) which are a friction push-fit one into the other to effect a releasable sealing connection between the blade assembly (6) and the liner (12).

7 Claims, 6 Drawing Sheets

WASTE CATCHMENT SYSTEM FOR ROLLERS

TECHNICAL FIELD

This invention relates to a waste catchment system for rollers, and has particular, though not exclusive, application to such a system for collecting waste liquids, inks or print-related substances from rollers used in the printing industry.

BACKGROUND ART

It is conventional practice in the printing industry to remove waste liquids, inks or print-related substances from rollers using a blade of rubber or similar material the edge of which engages with the rotating roller to scrape the surplus material from the roller, the waste material then being directed into a wash-up tray.

The wash-up trays need to be cleaned regularly, and this can be a messy and time-consuming exercise which can result in undesirable exposure to, and contact with, printing waste and chemicals.

It has therefore been proposed, for example as disclosed in WO94/19193 and DE-U-92 00 319, to provide the wash-up tray with a liner which protects the wash-up tray and retains the waste material therein. On completion of the roller cleaning process, the liner and waste material are removed from the wash-up tray and are disposed of, a replacement liner then being inserted into the wash-up tray for subsequent collection purposes.

Conventionally, the liners were releasably attached to the blades by means of double sided adhesive tape. However, such an arrangement suffers from a number of disadvantages not the least of which is that, being prone to contact by chemicals, in particular solvents, the tape is liable to be degraded by the waste materials and to lose its adhesion, whereby the liner can become displaced from its operative position during the cleaning process.

It has been proposed, for example as disclosed in DE-U-8903674, to provide a thickened upper edge to the liner which is received in a slot formed in the lower regions of the blade to interconnect the liner and the blade. Such an arrangement simplifies attachment of the liner to, and release of the liner from, the blade.

However, there are still problems associated with removal of the liner from the tray when full of waste material because of the fluid nature of the waste material.

SUMMARY OF THE INVENTION

It would be desirable to be able to provide a waste catchment system for a roller in which waste material is scraped from the roller by a blade and is directed into a wash-up tray containing a removable liner, in which the means for attaching the liner to the blade are such as to eliminate the use of double-sided adhesive tape for said attachment, and which overcomes the problems associated with removal of the liner from the tray.

According to the present invention there is provided a waste catchment system for a roller comprising an elongate tray, a blade assembly attached to, to extend the length of, the tray and including a blade located above the tray the free edge of which is adapted to engage with a roller to be cleaned whereby waste material from the roller is removed therefrom by the blade and is directed towards the tray, and a liner one edge of which is attached to the blade assembly whereby the liner lines the tray to receive therein the waste material, the blade assembly and the one edge of the liner being provided with co-operating male/female elements which are a friction push-fit one into the other to effect a releasable sealing connection therebetween, characterised by, between the liner and the tray, a removable rigid support element the transverse section of which conforms substantially with that of the tray and the liner, the support element receiving therein the liner to facilitate removal of the liner from the tray.

It will be appreciated that the mechanical leakproof coupling effected between the liner and the blade assembly is not prone to attack by the content of the waste material, and therefore remains in a positive operative position throughout the roller cleaning process and regardless of the chemical nature of the waste material, while the presence of the rigid support element facilitates removal of the liner from the tray when the liner contains waste material.

In a preferred embodiment of the invention, the male element is provided on the liner, and the female element is provided in the blade assembly, more preferably in the blade.

The male element may comprise a bead, preferably of circular transverse section, extending the length of the one edge of the liner, the female element comprising an elongate groove of corresponding transverse section extending the length of the blade assembly.

Alternatively, the male element may comprise a tenon extending the length of the one edge of the liner, the female element comprising an elongate mortise of corresponding section extending the length of the blade assembly.

Conveniently a release mechanism, for example a pull strip, is provided at one end of the male/female connection to initiate release of the male element from the female element.

In order to minimise movement of liquid waste material in the liner, the waste chatchment system may include a plurality of longitudinally spaced baffle plates within the liner each extending transversely of the liner.

DESCRIPTION OF THE PREFERRED EMBODIMENTS

Figure 1:
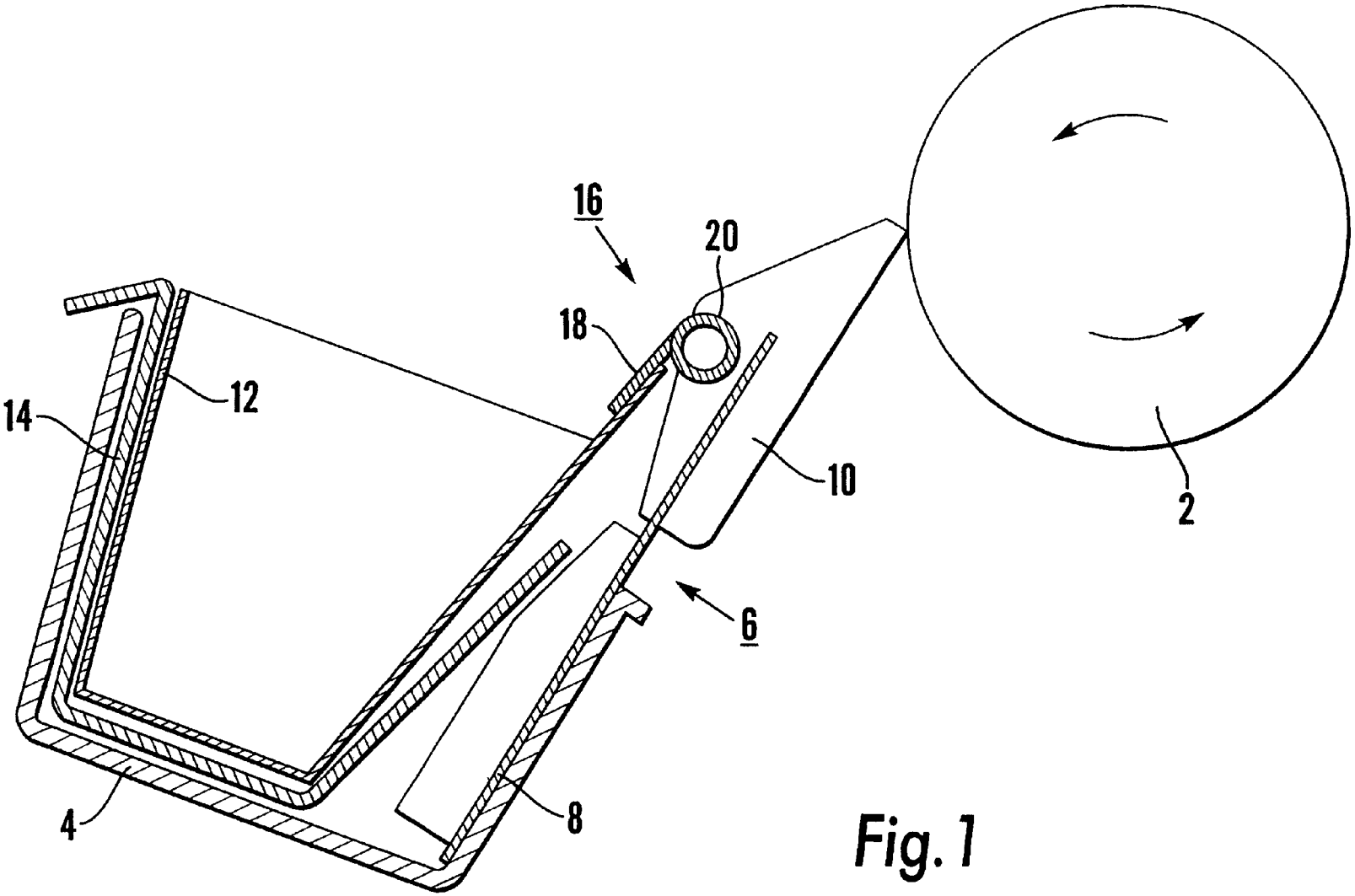
FIG. 1 is a transverse section through a waste catchment system according to the invention.

The waste catchment system of the invention is primarily for receiving waste material from the surface of a rotating roller such as shown at 2 in FIG. 1, which roller is typically part of an industrial printing press mechanism.

As with conventional arrangements, the illustrated waste catchment system includes an elongate wash-up tray 4, typically of steel, to which is attached a blade assembly indicated generally at 6. The assembly 6 comprises a support plate 8, typically of metal, bolted or otherwise secured to the inner face of one of the sidewalls of the wash-up tray 4 to extend substantially the length of the tray 4.

Mounted along, to extend the length of, the upper edge extent of the plate 8 is a blade 10, preferably of rubber or polyurethane. The blade 10 may be moulded to, extruded on, glued to or otherwise affixed to the plate 8, and has a tip adapted to engage with the outer surface of the roller 2 in conventional manner.

The system further includes a liner 12 the shape of which conforms substantially with the internal shape of the wash-up tray 4, and which seats in, to line, the wash-up tray 4.

The liner 12 is preferably a laminate consisting of, for example, inner and outer layers of polyethylene between which are sandwiched layers of aluminium foil, polyethylene and paper. The precise materials and rigidity of the liner are chosen to suit particular requirement, but clearly one or more layers must be solvent resistant and capable of withstanding any chemicals to be removed from the roller 2.

Conveniently the liner 12 is created from a flat, blank sheet of material which is cut, creased and folded into the final leak-proof, tray-like configuration.

A support element 14, conveniently of aluminium, plastic or the like of generally U-shaped transverse section and open at its ends is positioned in the wash-up tray 4 between the wash-up tray 4 and the liner 12 to extend substantially the length of the liner 12 to facilitate removal of the liner 12 from the wash-up tray 4 when the liner 12 contains waste material.

The means by which the liner 12 is attached to the blade assembly 6 is such as to ensure that all waste material from the roller 2 is directed into the liner 12 and such as to enable a liner 12 to be readily inserted into and removed from the system.

More particularly, the upper edge of the wall of the liner 12 adjacent the blade assembly 6 has an attachment strip indicated generally at 16 connected thereto to extend the length thereof, the attachment strip conveniently being moulded from, for example, PVC, polyethylene, thermoplastic, rubber or synthetic resin, and including a flat flange portion 18 secured to the liner 12 by gluing, moulding, welding or the like, and a hollow bead portion 20 of circular cross-section.

Figure 2:
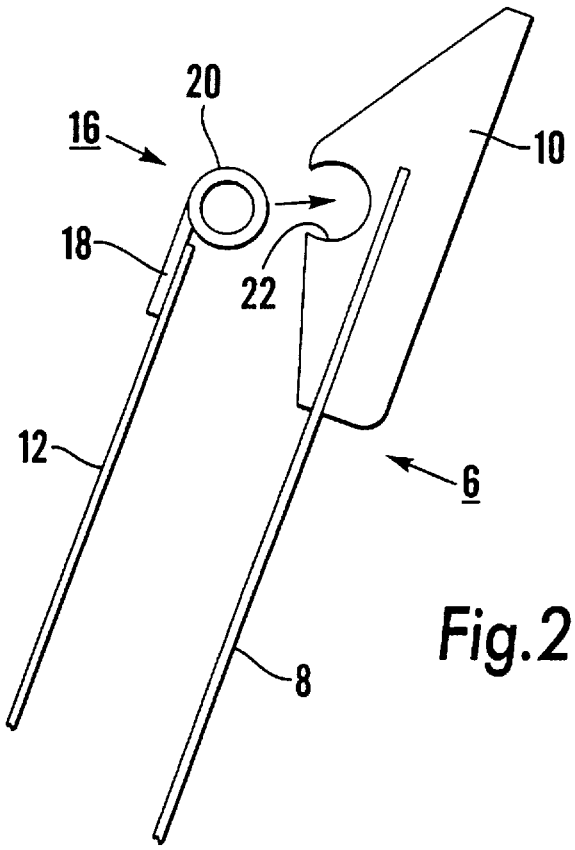
FIG. 2 shows the male and female elements of the system of FIG. 1 prior to connection.

A correspondingly-shaped, open-sided groove or recess 22 is formed in the blade 10 as best seen in FIG. 2 to extend the length of the blade 10 and to receive therein the bead portion 20, said bead portion 20 being a friction push-fit into the recess 22 to effect a leak-tight seal therein.

Figure 3:
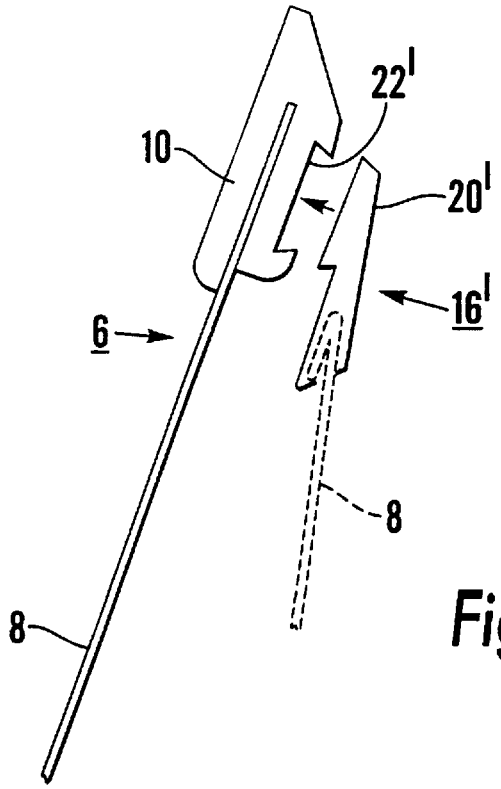
FIG. 3 shows alternative male and female connectors of a waste catchment system according to the invention prior to connection.

Clearly the precise configuration of the attachment strip and the corresponding recess in the blade may differ from that shown in FIGS. 1 and 2, and may be, for example, as shown in FIG. 3. FIG. 3 shows an attachment strip 16' including a dovetail section tenon portion 20' which is a push-fit into a correspondingly shaped mortise recess 22', the strip 16' being connected to the liner 12 by a clip fastening.

Figure 4:
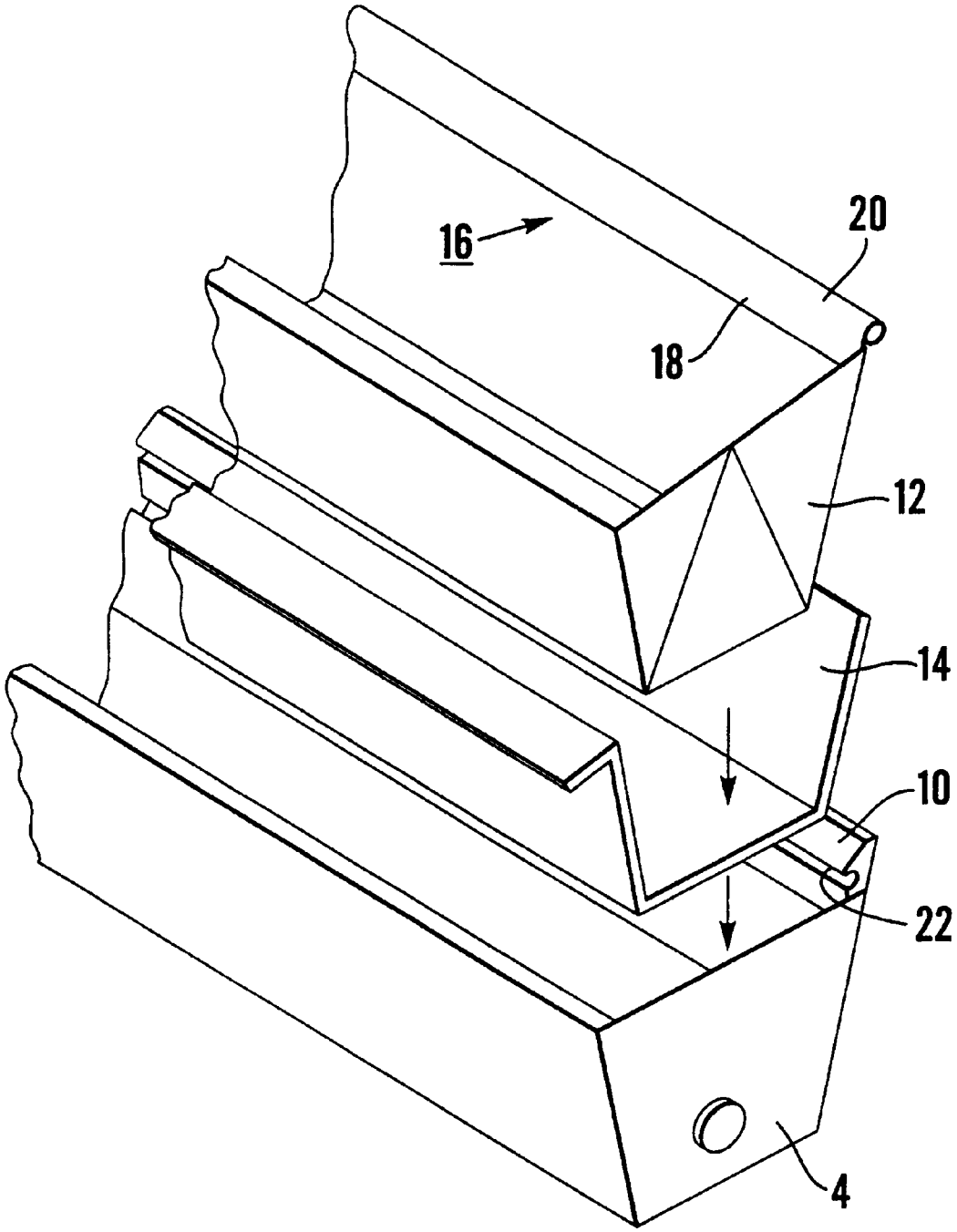
FIG. 4 shows, in exploded form, part of a waste catchment system according to the invention.

The described waste catchment system is assembled as shown in FIG. 4, the support. element 14 being located in the wash-up tray 4, the liner 12 being located in the support element 14, and the attachment strip 16 being pushed into position on the blade 10. It will be appreciated that such an arrangement enables liquid displaced from the roller 2 by the tip of the blade 10 to flow down over the blade 10, over the attachment strip 16 and into the liner 12 without contacting any surfaces other than those of the liner 12.

Figure 5:
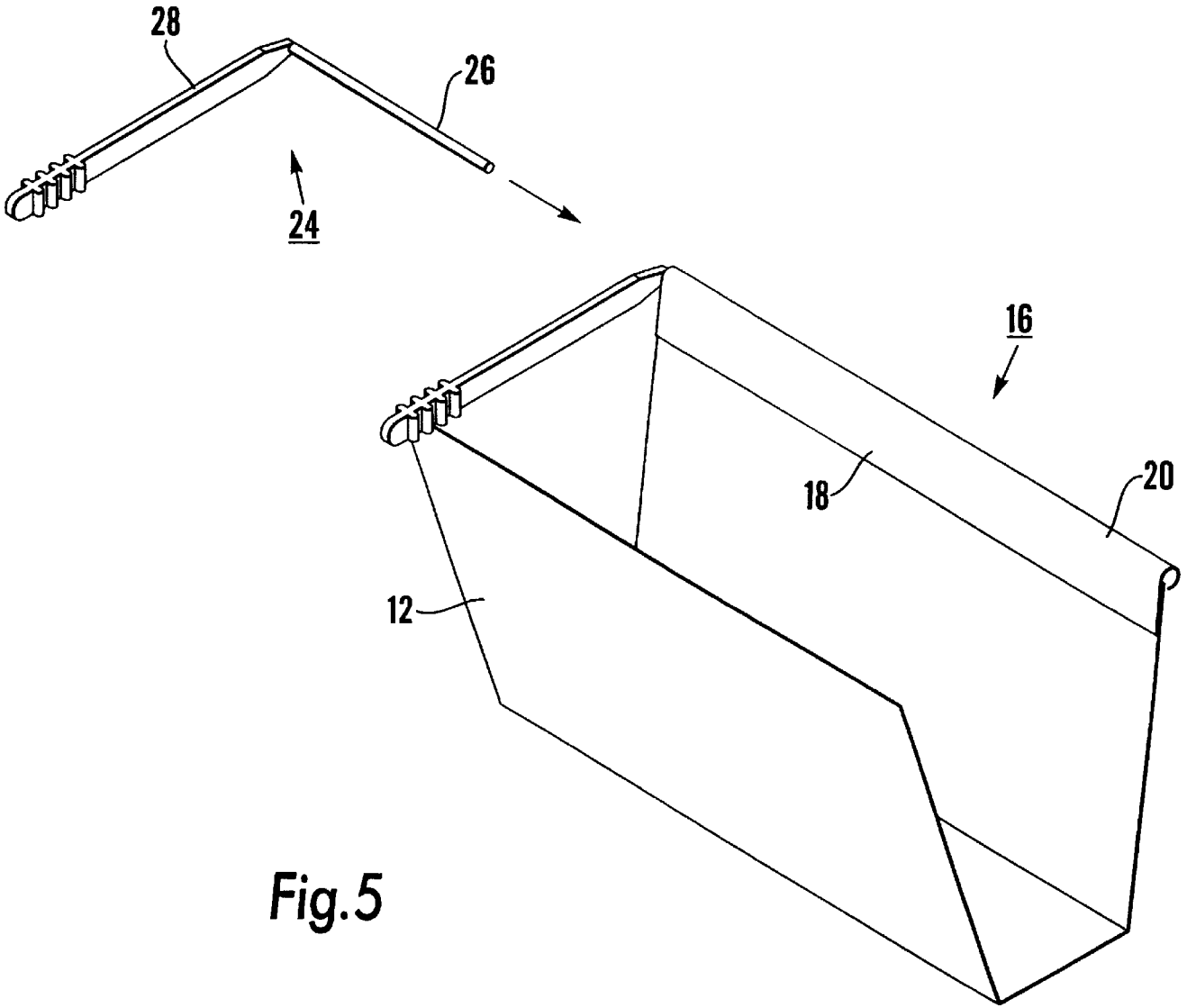
FIG. 5 shows a release mechanism for a waste catchment system according to the invention.

Referring to FIG. 5, the waste catchment system incorporates a mechanism to enable ready release of the attachment strip 16 from the recess 22 in the blade 10 and whereby the liner, once full, can be removed from the wash-up tray 4.

More particularly, a pull mechanism 24 has a first arm portion 26 which is freely located in one end extent of the hollow bead portion 20, and a second arm portion 28 extending perpendicularly from the first arm portion 26 which can be gripped by a user and pulled whereby the one end extent of the bead portion 20 is disengaged from the recess 22 in the blade 10. After this initial disengagement, the remainder of the bead portion 20 can be released from the recess 22, and the liner 12 can thereafter be removed from the wash-up tray 4 for disposal purposes.

Figure 6:
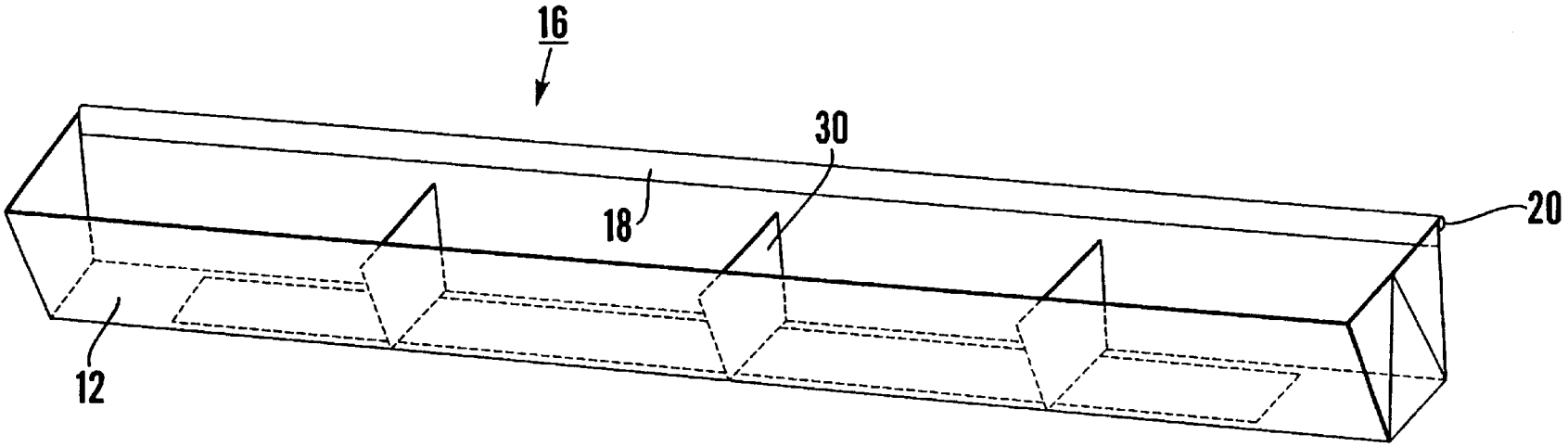
FIG. 6 shows the liner of a waste catchment system according to the invention provided with baffle plates.

In order to minimise movement of waste material in the liner 12, particularly low viscosity liquid waste, the liner 12 may incorporate a series of longitudinally spaced, transverse baffle plates such as those referenced 30 in FIG. 6 which divide the liner 12 into a number of separate chambers.

Alternatively, or additionally, a length of absorbent material, for example sponge, may be provided in the bottom of the liner 12 to draw, retain and stabilise thinner waste materials.

In the case of relatively long wash-up trays 4, it may be desirable to incorporate transverse stiffener bars extending across the liner 12 between the opposed sidewalls thereof at periodic positions therealong to add rigidity to the liner 12.

Figure 7:
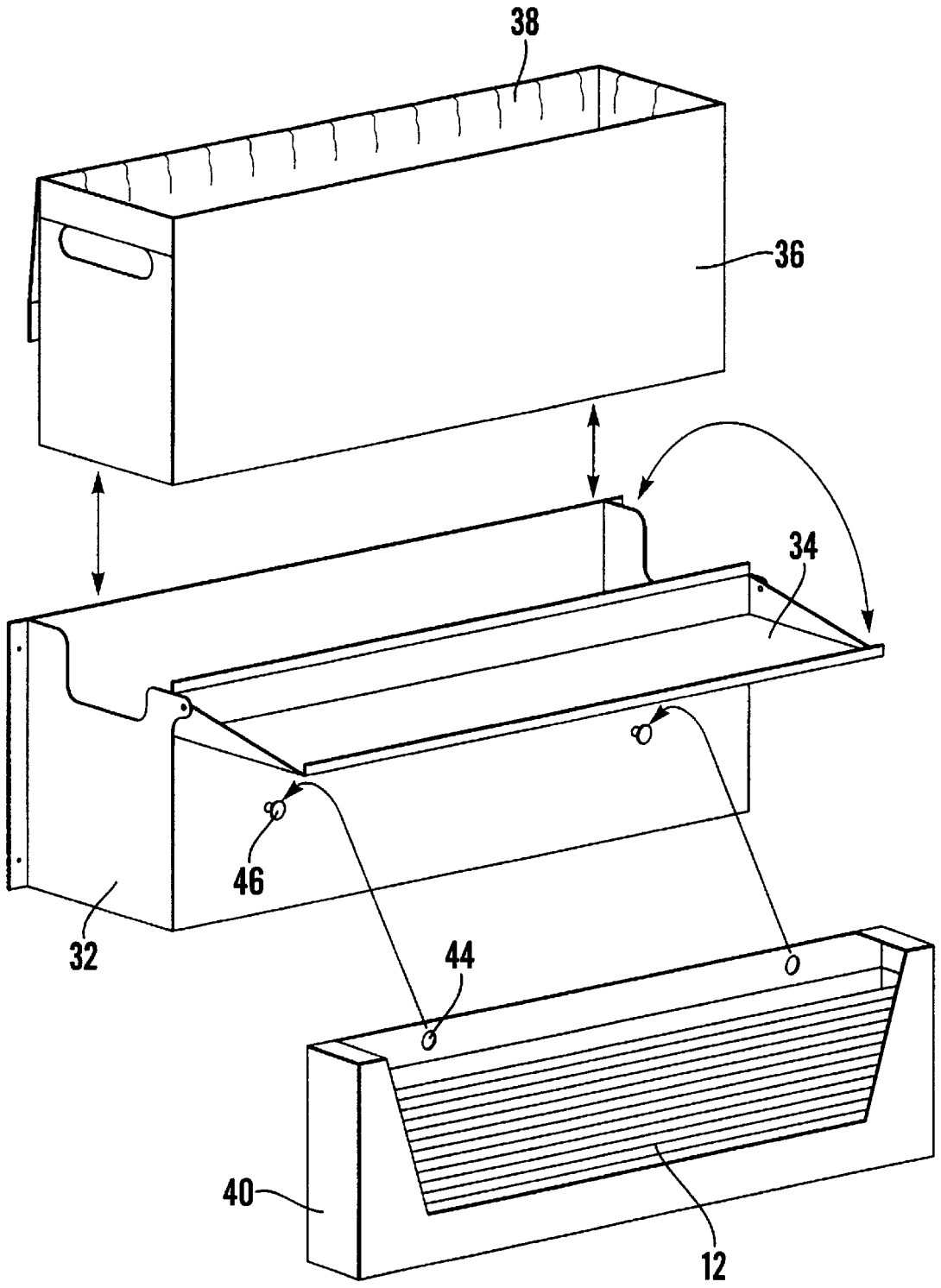
FIG. 7 shows, in exploded form, a dispenser for disposable liners of a waste catchment system according to the invention.

Referring to FIG. 7, there is illustrated a complete package for supplying fresh liners to, and accepting soiled liners from, the waste catchment system of the invention.

This package comprises a box-like bin frame 32 having a hinged lid 34 and into which is inserted a bin 36 provided with a liquid-proof liner 38. A dispenser 40 contains a number of preformed, sealed liners 12, the dispenser 38 having a pair of holes 44 therein adapted for location over a pair of supports 46 on the outside of the frame 32.

The package is initially supplied with the dispenser 40 within the bin 36 and the bin 36 within the frame 32 with the lid 34 closed.

In use, the lid 34 of the frame 32, which may be wall, floor or trolley mounted, is opened to provide a platform as shown, and the dispenser 40 is removed from the bin 36 and is located on the supports 46 to be suspended on the frame 32.

Thus it will be appreciated that soiled liners 12 from wash-up trays 4 can be disposed of into the bin 36, and replacement liners 12 can be removed from the dispenser 40 and fitted as appropriate using the lid 34 as a support.

Clearly, and as already exemplified, the precise construction of the waste catchment system of the invention may differ from that described and illustrated without departing from the scope of the appended claims, providing the system embodies co-operating male and female components on the liner and the blade assembly which are a friction push-fit one into the other to effect a releasable sealing connection therebetween, and a rigid support element for the liner. Of the co-operating male and female components, the male component may be on the blade assembly and the female component on the liner, while the component on the blade assembly may be on the plate portion thereof rather than the blade it is however preferred that the connection is as near to the tip of the blade as is practical.

The baffle plates 30, the absorbent material lining the liner 12 and the transverse stiffener bars may or may not be present, while the release mechanism for initially disengaging the attachment strip from the blade may be other than as shown.

The material of the liner 12, the attachment strip 16 and the blade 10 are chosen to suit particular requirements, in particular the chemical nature of the material to be removed from the rollers 2, while the connections between the blade 10 and the plate 8, and between the attachment strip 16 and the liner 12 can be effected in a variety of ways.

Other modifications and variations will be apparent to those skilled in the art.

Thus there is provided a waste catchment system for a roller, in particular a roller in a printing press, in which the connection between the liner and the blade assembly is not prone to degradation by the waste material scraped from the roller, the connection, once effected, remaining positively operative throughout the roller cleaning process, but being readily releasable to enable disposal of a soiled liner, and in which removal of the liner from the tray is facilitated compared with known systems.

What is claimed is:

1. A waste catchment system for a roller comprising an elongate tray, a blade assembly attached to, to extend the length of, the tray and including a blade located above the tray the free edge of which is adapted to engage with a roller to be cleaned whereby waste material from the roller is removed therefrom by the blade and is directed towards the tray, and a liner one edge of which is attached to the blade assembly whereby the liner lines the tray to receive therein the waste material, the blade assembly and the one edge of the liner being provided with co-operating male/female elements which are a friction pushfit one into the other to effect a releasable sealing connection therebetween, characterized by, between the liner and the tray, a removable, rigid support element the transverse section of which conforms substantially with that of the tray and the liner, the support element receiving therein the liner to facilitate removal of the liner from the tray.

2. A waste catchment system as claimed in claim 1 in which the male element is provided on the liner, and the female element is provided in the blade assembly.

3. A waste catchment system as claimed in claim 2 in which the female element is provided in the blade.

4. A waste catchment system as claimed in claim 2 in which the male element comprises a bead extending the length of the one edge of the liner, the female element comprising an elongate groove of corresponding section to that of the bead extending the length of the blade assembly.

5. A waste catchment system as claimed in claim 2 in which the male element comprises a tenon extending the length of the one edge of the liner, the female element comprising an elongate mortise of corresponding section extending the length of the blade assembly.

6. A waste catchment system as claimed in claim 1 in which a release mechanism is provided at one end of the male/female connection to initiate release of the male element from the female element.

7. A waste catchment system as claimed in claim 1 and including a plurality of longitudinally spaced baffle plates within the liner each extending transversely of the liner.

* * * * *